US007624484B2

(12) United States Patent
Lundh

(10) Patent No.: US 7,624,484 B2
(45) Date of Patent: Dec. 1, 2009

(54) CLASP

(76) Inventor: Joran Lundh, c/o LASCAL Ltd - Suite 919, 9th flr, Tower 3-City, 33 Canton Road, Kowloon, HK (CN)

( * ) Notice: Subject to any disclaimer, the term of this patent is extended or adjusted under 35 U.S.C. 154(b) by 0 days.

(21) Appl. No.: 12/159,947

(22) PCT Filed: Dec. 19, 2006

(86) PCT No.: PCT/SE2006/001435

§ 371 (c)(1),
(2), (4) Date: Jul. 2, 2008

(87) PCT Pub. No.: WO2007/078231

PCT Pub. Date: Jul. 12, 2007

(65) Prior Publication Data

US 2008/0301916 A1 Dec. 11, 2008

(30) Foreign Application Priority Data

Jan. 3, 2006 (SE) ..... 0600007

(51) Int. Cl.
*A44B 11/26* (2006.01)

(52) U.S. Cl. ..... 24/607; 24/627; 24/628

(58) Field of Classification Search ..... 24/110, 24/607, 606, 627, 628
See application file for complete search history.

(56) References Cited

U.S. PATENT DOCUMENTS 1,563,350 A * 12/1925 Field et al. ..... 24/110
1,678,240 A 7/1928 Benz
5,355,562 A 10/1994 Matoba et al.
5,438,737 A 8/1995 Anscher et al.
6,290,112 B1 9/2001 Iver
6,330,736 B1 12/2001 Cheng

FOREIGN PATENT DOCUMENTS

DE 3314541 10/1984

OTHER PUBLICATIONS

International Search Report from corresponding International, Application No. PCT/SE2006/001435, mailed Mar. 22, 2007.

(Continued)

*Primary Examiner*—James R Brittain
(74) *Attorney, Agent, or Firm*—Polster, Lieder, Woodruff & Lucchesi, L.C.

(57) ABSTRACT

The present invention relates to a clasp for the connecting of two parts comprising a first (1) and a second (2) clasp part consisting of, against the first part (1) fixed, and from this extending part (3), in the second part (2) an opening (3) the shape of which closely connects to the outer shape of the extending part (3) so that the second part (2) can pass over the latter as well as the means, to restrain the second part on the extending part (3), in the spring-loaded means (8, 10, 11) and an edge or groove (5) arranged inside the second part's opening. The clasp consists of spring-loaded means (6, 7) designed to move the parts away from each other upon the parts being released. A button (4) arranged in the cylinder is placed for activation when the clasp's parts are to be released from each other.

5 Claims, 4 Drawing Sheets

OTHER PUBLICATIONS

Written Opinion of the International Searching Authority from corresponding International Application No. PCT/SE2006/001435, mailed Mar. 22, 2007.

International Search Report from corresponding International Application No. PCT/SE2006/001435, mailed Mar. 22, 2007.

* cited by examiner

CLASP

CROSS-REFERENCE TO RELATED APPLICATIONS

This application is the US National Stage under 35 U.S.C. §371 of International Application No. PCT/SE/2006/001435, having an international filing date of Jan. 3, 2007, and claims priority to Swedish Application No. 060007-9 filed Jan. 3, 2006. The disclosure of both the International Application and the Swedish priority application are incorporated herein by reference.

BACKGROUND

The present invention concerns a clasp for the connecting together of at least two parts, for example, the belts of a harness.

The clasp of the type to which the invention refers can be utilized for detachable connections of belts, bands and other parts in many different contexts. In various forms of execution the clasp can permit greater or smaller movement on the part of the connected parts and may thereby be suited to the requirements that can exist in the various applications.

BRIEF SUMMARY OF THE DISCLOSURE

The object of the present invention is to indicate an improved clasp that can be secured and loosened with one hand. It is also an object of the invention to provide a clasp, the release mechanism of which requires actuation at only one place.

A clasp in accordance with the invention comprises two parts, a first part with a securing and release mechanism and a second part that comprises the means for co-ordination with the mechanism in the first part. This means is comprised in the first instance of arrangements in which one or more parts of the mechanism's moveable parts can intervene. The co-ordination medium preferably also comprises arrangements for facilitating the separation of the two parts when they are released from each other.

BRIEF DESCRIPTION OF THE SEVERAL VIEWS OF THE DRAWINGS

The invention shall be described in detail below in connection with the example of a preferred embodiment as shown in attached drawings.

DETAILED DESCRIPTION

Figure 1:
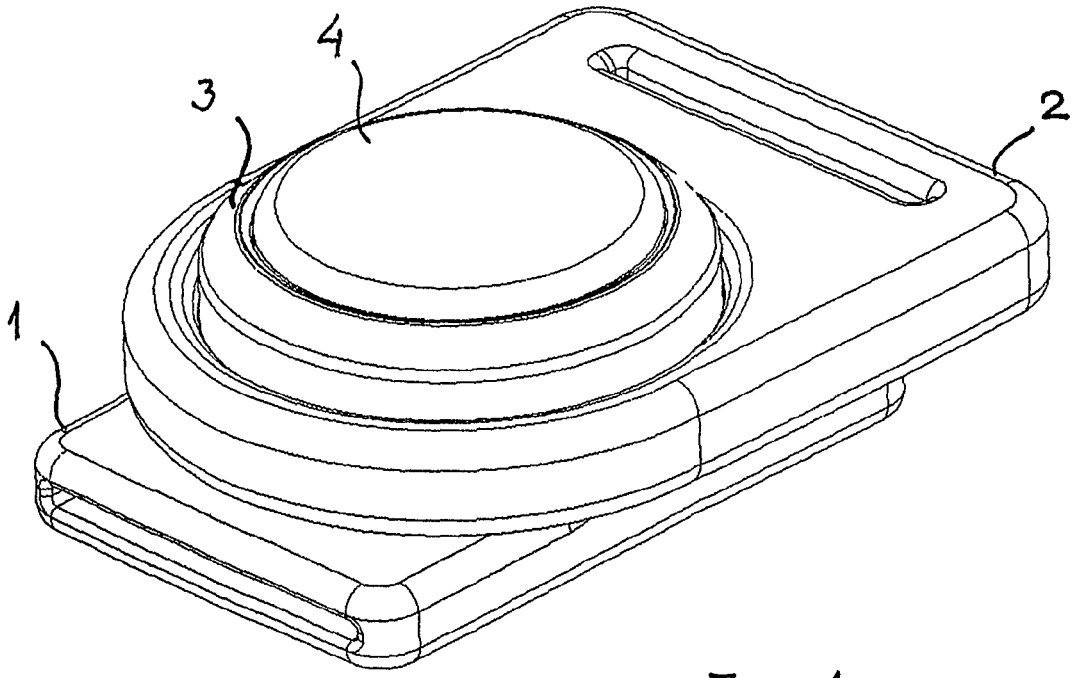
FIG. 1 is a perspective view of a clasp in accordance with the invention.
Figure 2:
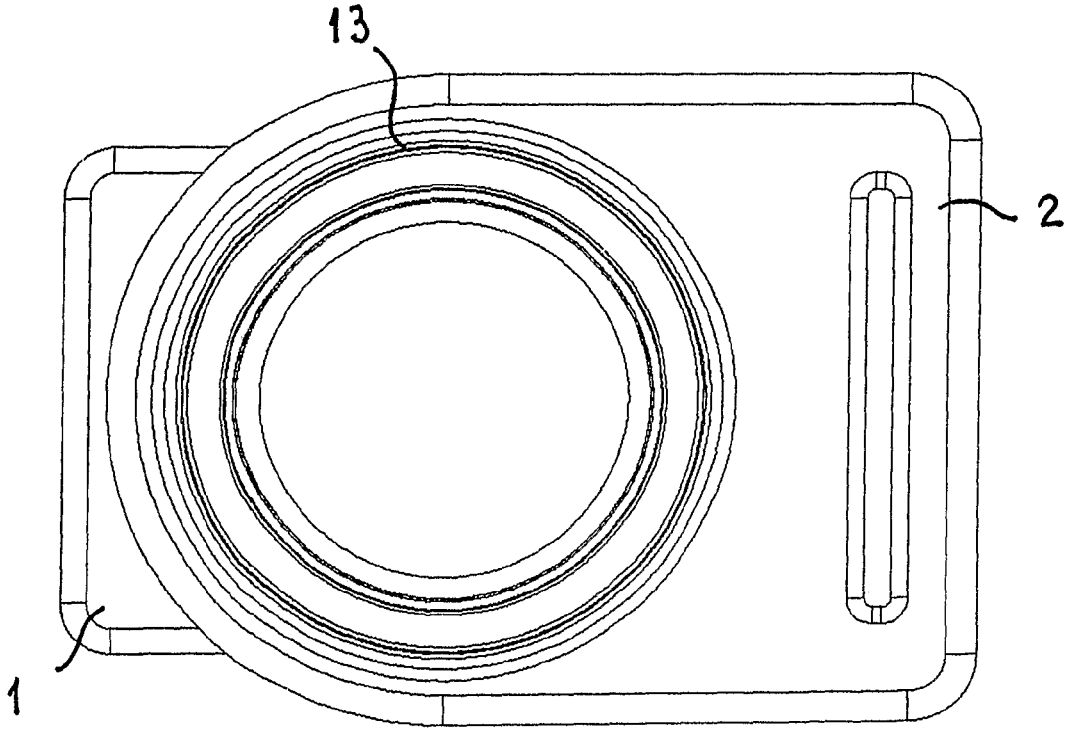
FIG. 2 is a top plan view of the clasp.
Figure 3:
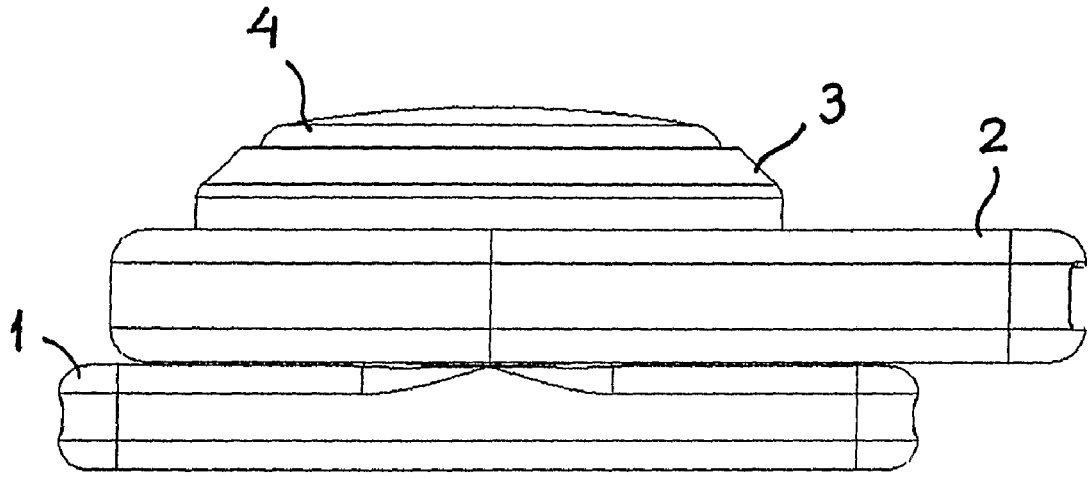
FIG. 3 is a side elevational view of the clasp.
Figure 4:
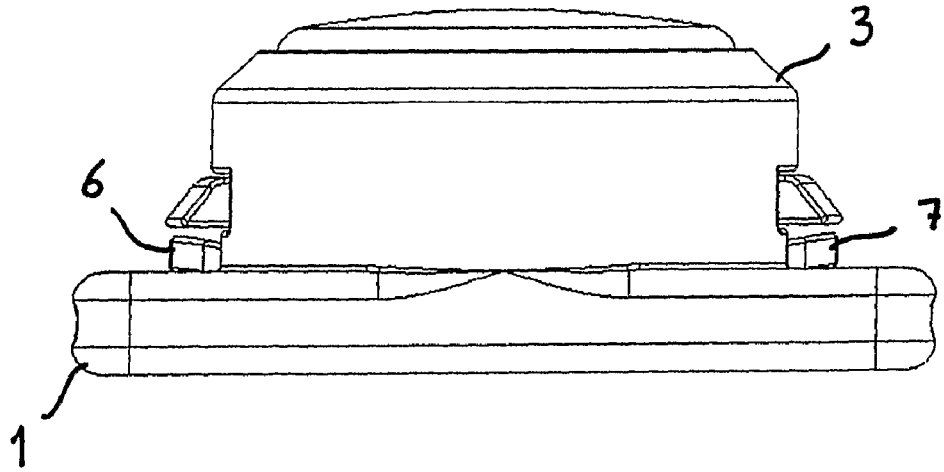
FIG. 4 is a side elevational view of a first part of the clasp.
Figure 5:
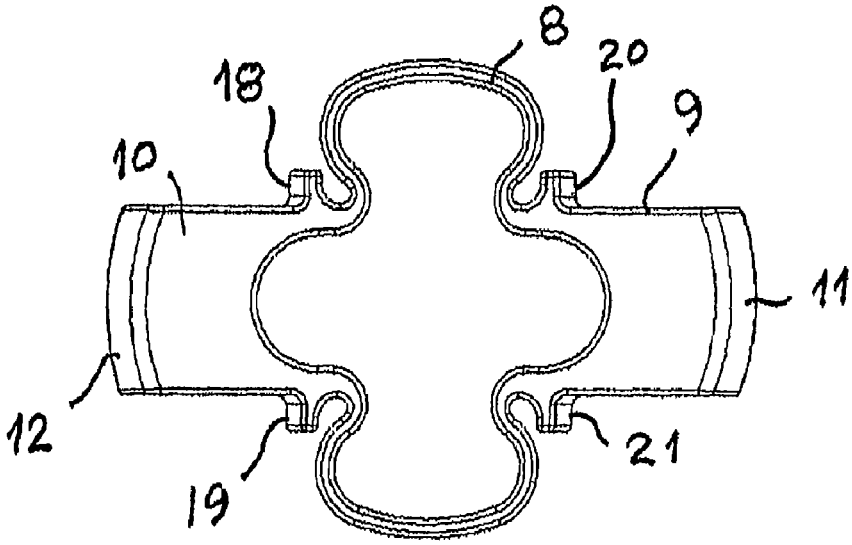
FIG. 5 is a view of a part included in the clasp's mechanism.
Figure 6:
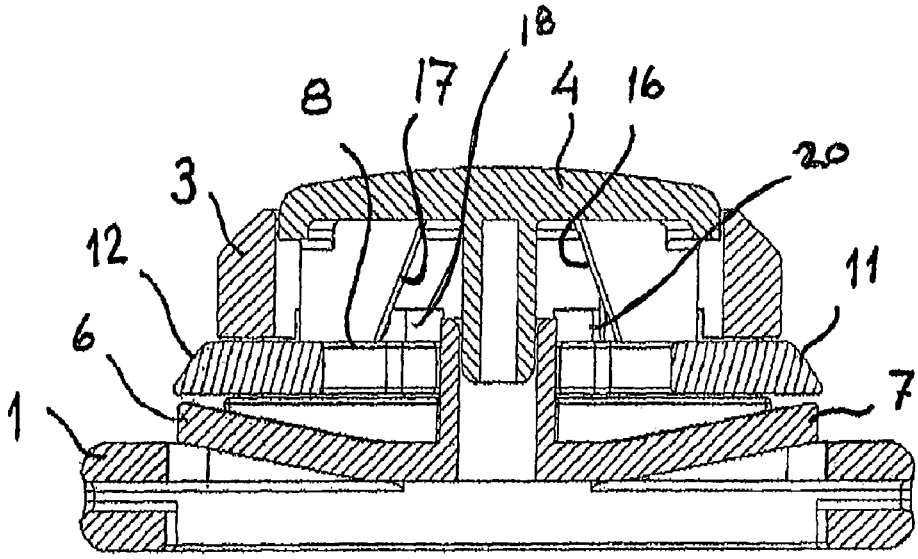
FIG. 6 is a cross-sectional view of the clasp first part.
Figure 7:
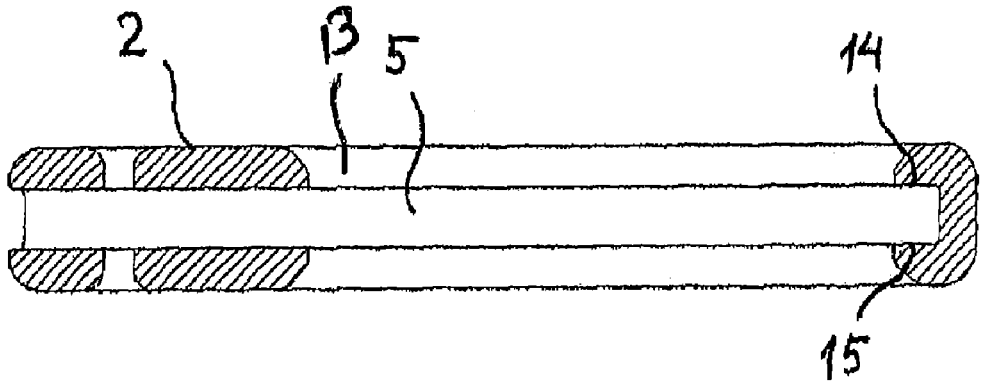
FIG. 7 is a cross-sectional view of the a second part of the clasp.

The clasp is comprised of a first part 1 with a mechanism for retaining and releasing a second clasp part 2. In the figures, the first part 1 is shown as a plate which can be attached to a desired underlay. The first part and/or the second part may also constitute an integrated part of a larger piece as will be exemplified in greater detail in the following. The first part 1 includes a central part 3 that, in the preferred embodiment shown in the drawings, is a hollow, circular cylinder that is at right angles to, and extends from the plate of the first part 1. The cylindrical central part 3 is tubular and is bordered at an upper end thereof by the surface of a push-button 4. The button 4, as seen in FIG. 6, includes a head portion and a pin or stem cylinder extending from a bottom of the head portion.

The second part 2 of the clasp is shown in the figures as a plate with a circular hole 13, the diameter of which is somewhat greater than the diameter of the central part 3. The circular hole 13 has an interior groove 5 which is bordered by an upper edge 14 and a lower edge 15.

Figure 8:
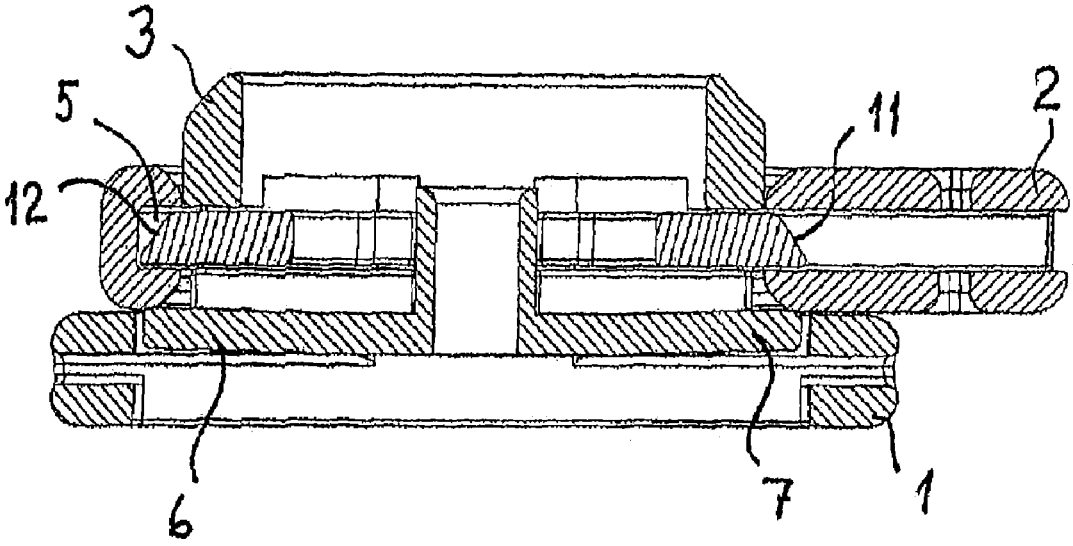
FIG. 8 is a cross-sectional view of the clasp's first and second parts without the pushbutton.

The mechanism for releasing and maintaining the clasp second part 2 includes a spring-loaded locking device 8 which is positioned inside the cylinder 3 and rests on the latter's bottom or in connection to this arranged medium. The locking device 8 includes a ring-shaped or similarly shaped spring as well as two tongues 9, 10 with beveled outer edges 11, 12. The tongues 9,10 are telescopically arranged in openings in the casing surface of the central part 3 to extend radially outwardly from the openings in the central part 3. Two spring-loaded tongues 6,7 are positioned beneath the tongues 9,10. The tongues 6,7 extend outwardly from the bottom of a cylinder, and can pivot with respect to the cylinder as can be seen by comparing FIGS. 6 and 8 between a relaxed position (FIG. 6) in which the tongues 6,7 extend out of a plane of the clasp first part and a second, engaged position (FIG. 8) in which the tongues are generally co-planar with the plane of the clasp first part. The cylinder from which the tongues extend telescopingly engages the pin of the button 4.

When the second clasp part 2 is introduced over the central part 3 and pressed down over the central part towards plate 1, the locking device's tongues 9, 10 are pressed under spring action in towards the center of the clasp, moving the locking device from a relaxed position to a collapsed position; thereby permitting the clasp part 2 to pass downwards towards the spring-loaded tongues 6, 7 in the first part 1. These tongues 6,7 are pressed somewhat downwards so that the spring-loaded tongues 9, 10 can squeeze into the groove 5 and hold the other clasp part 2 in a determined position in relation to the central part 3. Because the central part 3 is shown to be a cylinder, and is thus circular, the second part 2 can rotate freely on the central part in this position. Securing and releasing of the second part 2 can then take place in an arbitrary position.

The push-button 4 includes downwardly directed rods 16, 17 with somewhat beveled edges. The rods 16,17, which are preferably four in number and in parallel pairs, extend towards the contact surfaces 18, 19, 20, 21 of the spring-loaded ring 8. When the button 4 is pressed downwardly, the spring 8 is pressed together and the spring-loaded tongues 9, 10 are pulled back, moving the locking mechanism from its relaxed position to its compressed position, thereby disengaging the tongues 9, 10 from the second part groove 5 so that the second clasp part 2 is released from the first clasp part 1. The spring-loaded tongues 6, 7 in the first part press the second part 2 somewhat upwardly so that, when the pressure on the button 4 ceases, the tongues 9, 10 cannot again squeeze into, and engage, the groove 5, so that the two clasp parts remain free from each other.

The push-button 4 is kept in position through snap arrangements that telescopically grip into the cylindrical part 3. These arrangements do not form part of the invention and are not shown in the figures. Button 4 is controlled, apart from the cylinder's walls, by a centrally positioned downwards directed pin that runs in the corresponding tube from which the tongues 6,7 extend.

Over and above what is described above, different embodiments are possible for the invention concept. The central part, which is described above as being circular and the corresponding hole 13 in the second clasp part 2 may have some other shape that is suitable for a relevant application. The shape may for example be square, rectangular or elliptical, which affords different possibilities of varying the clasps' parts varying positions to four or two respectively, alternatively without affording it the possibility of free rotation around the central part as that provided by the circularly shaped central part. There are also other shapes that permit only one mutual position between the first and second parts upon connection. An arrangement in accordance with the invention may also be used for connecting together more than two parts. This appropriately occurs with a part constructed like the first part described above as well as two or more "other parts" which can have individual securing arrangements of the nature described above. Alternatively, only the outermost positioned of these "other parts" could have such a securing arrangement. The spring-loaded function in the locking device's tongues may be achieved by means of differently shaped springs.

The clasp may, according to the invention, be employed for many different purposes, for example for belts in harnesses, rucksacks and the like, for securing of belts and bands in vehicles, toys and pushchairs as well as in clothes and equipment for sport and leisure. The clasp's one or both parts may thereupon constitute integrated parts of the pieces in which they are employed. In all these applications the clasp's property is that of being able to be maneuvered simply by means of one hand to advantage.

The invention claimed is:

1. A clasp comprised of a first part, a second part, a retaining mechanism for maintaining the clasp parts, and a button for releasing said second part from said first part;

said first part comprising a plate having a central member extending from said plate;

said retaining mechanism comprising a spring member; said spring member being movable between a compressed position and a relaxed position; the spring member comprising a ring-shaped spring from which two diametrically opposed tongues extend;

said second part comprising an opening sized and shaped to fit over said central part and said retaining mechanism spring member, and a groove along an inner surface of said second part opening said tongues of said retaining mechanism being sized and shaped for engagement with said second part opening groove; whereby said spring member is moved from said relaxed position to said compressed position as said second part is moved over said retaining mechanism and wherein said spring member moves back to said relaxed position when said second part is adjacent said first part; said retaining mechanism engaging said second part to retain the second part on the first part central member;

said button engaging said retaining mechanism spring member; such that when said button is pressed, said button moves said spring member from said relaxed position to said compressed position to disengage said spring member from said clasp second part; whereby said second part can be removed from said first part.

2. A clasp comprised of a first part, a second part, a retaining mechanism for maintaining the clasp parts, and a button for releasing said second part from said first part;

said first part comprising a plate having a central member extending from said plate;

said retaining mechanism comprising a spring member and a pair of tongues; said tongues each including an inner end, an outer end, and a contact surface spaced inwardly from said outer end of said tongue; said spring member being movable between a compressed position in which said tongues are in a retracted position and a relaxed position in which said tongues are in an extended position;

said second part comprising an opening sized and shaped to fit over said central part and said retaining mechanism spring member, whereby said spring member is moved from said relaxed position to said compressed position, and hence said tongues are moved from said extended position to said retracted position, as said second part is moved over said retaining mechanism and wherein said spring member moves back to said relaxed position and said tongue move back to said extended position when said second part is adjacent said first part; said retaining mechanism tongues engaging said second part to retain the second part on the first part central member;

said button comprising rods extending diagonally outwardly from an underside of said button; each said rod engaging an outer surface of said contact surface; such that when said button is pressed, said rods of said button move relative to said contact surfaces to move said spring member from said relaxed position to said compressed position, and hence to move said tongues from said extended position to said retracted position, to disengage said tongues from said clasp second part; whereby said second part can be removed from said first part.

3. The clasp of claim 2 wherein central member is hollow, said button being telescopingly received in said central member.

4. The clasp of claim 3 wherein said rods have beveled surfaces that face the spring-loaded part.

5. A clasp comprised of a first part, a second part, a retaining mechanism for maintaining the clasp parts, and a button for releasing said second part from said first part;

said first part comprising a plate having a central member extending from said plate;

said retaining mechanism comprising a first spring member; said first spring member being movable between a compressed position and a relaxed position;

said second part comprising an opening sized and shaped to fit over said central part and said retaining mechanism spring member, whereby said spring member is moved from said relaxed position to said compressed position as said second part is moved over said retaining mechanism and wherein said spring member moves back to said relaxed position when said second part is adjacent said first part; said retaining mechanism engaging said second part to retain the second part on the first part central member;

said button engaging said retaining mechanism spring member; such that when said button is pressed, said button moves said spring member from said relaxed position to said compressed position to disengage said spring member from said clasp second part; whereby said second part can be removed from said first part; and a second spring member positioned beneath said first spring member; said second spring member having a pair of opposed tongues; said tongues being sized to be engaged by a lower surface of clasp second part when said second part is applied over said first part; said tongues of said second spring member being pivotal between a relaxed position in which said tongues extend out of a plane of said clasp first member and a second position in which said tongues are generally co-planar with the plane of said clasp first member; whereby, when said button is depressed, said tongues of said second spring member urge said clasp second part upwardly, away from said first spring member to prevent re-engagement of said first spring member with said clasp second member upon release of said button.

* * * * *

UNITED STATES PATENT AND TRADEMARK OFFICE

CERTIFICATE OF CORRECTION

PATENT NO. : 7,624,484 B2
APPLICATION NO. : 12/159947
DATED : December 1, 2009
INVENTOR(S) : Joran Lundh It is certified that error appears in the above-identified patent and that said Letters Patent is hereby corrected as shown below:

In the Claims, Column 4, line 19, the word "tongue" should be --tongues--

Signed and Sealed this

Twenty-third Day of March, 2010

David J. Kappos

David J. Kappos
*Director of the United States Patent and Trademark Office*